US006605987B2

(12) United States Patent
Eberlein

(10) Patent No.: US 6,605,987 B2
(45) Date of Patent: Aug. 12, 2003

(54) CIRCUIT FOR GENERATING A REFERENCE VOLTAGE BASED ON TWO PARTIAL CURRENTS WITH OPPOSITE TEMPERATURE DEPENDENCE

(75) Inventor: Matthias Eberlein, Gilching (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/963,975

(22) Filed: Sep. 26, 2001

(65) Prior Publication Data

US 2002/0067202 A1 Jun. 6, 2002

(30) Foreign Application Priority Data

Sep. 26, 2000 (DE) ..... 100 47 620

(51) Int. Cl.[7] ..... G05F 1/10

(52) U.S. Cl. ..... 327/540; 327/542; 327/563; 323/313; 323/316

(58) Field of Search ..... 327/534, 535, 327/537, 538–541, 542, 543, 563; 323/313–315, 316, 268, 281; 330/252, 253, 257, 288, 289, 300

(56) References Cited

U.S. PATENT DOCUMENTS 4,088,941 A * 5/1978 Wheatley, Jr. ..... 323/226
4,234,841 A * 11/1980 Schade, Jr. ..... 323/268
5,120,994 A * 6/1992 Joly ..... 323/313
5,132,556 A * 7/1992 Cheng ..... 323/315
5,929,623 A 7/1999 Hoshino ..... 323/315

OTHER PUBLICATIONS

Degrauwe, Marc G.R. et al.: "CMOS Voltage References Using Lateral Bipolar Transistors", IEEE Journal of Solid-State Circuits, vol. SC–20, No. 6, Dec. 1985, pp. 1151–1157.

Rincon–Mora, Gabriel A. et al.: "A 1.1–V Current–Mode and Piecewise–Linear Curvature–Corrected Bandgap Reference", IEEE Journal of Solid–State Circuits, vol. 33, No. 10, Oct. 1998, pp. 1551–1554.

Banba, Hironori et al.: "A CMOS Bandgap Reference Circuit with Sub–1–V Operation", IEEE Journal of Solid–State Circuits, vol. 34, No. 5, May 1999, pp. 670–674.

* cited by examiner

*Primary Examiner*—Minh Nguyen
(74) *Attorney, Agent, or Firm*—Laurence A. Greenberg; Werner H. Stemer; Gregory L. Mayback

(57) ABSTRACT

A circuit for generating a temperature-stabilized reference voltage uses the current-mode technique, in which two partial currents are superimposed on each other and converted into the reference voltage. One partial current is generated by an asymmetric differential amplifier with two lateral bipolar transistors of different area. In order to generate the other partial current, an electrical resistor is disposed between the common node of the differential amplifier and ground.

8 Claims, 1 Drawing Sheet

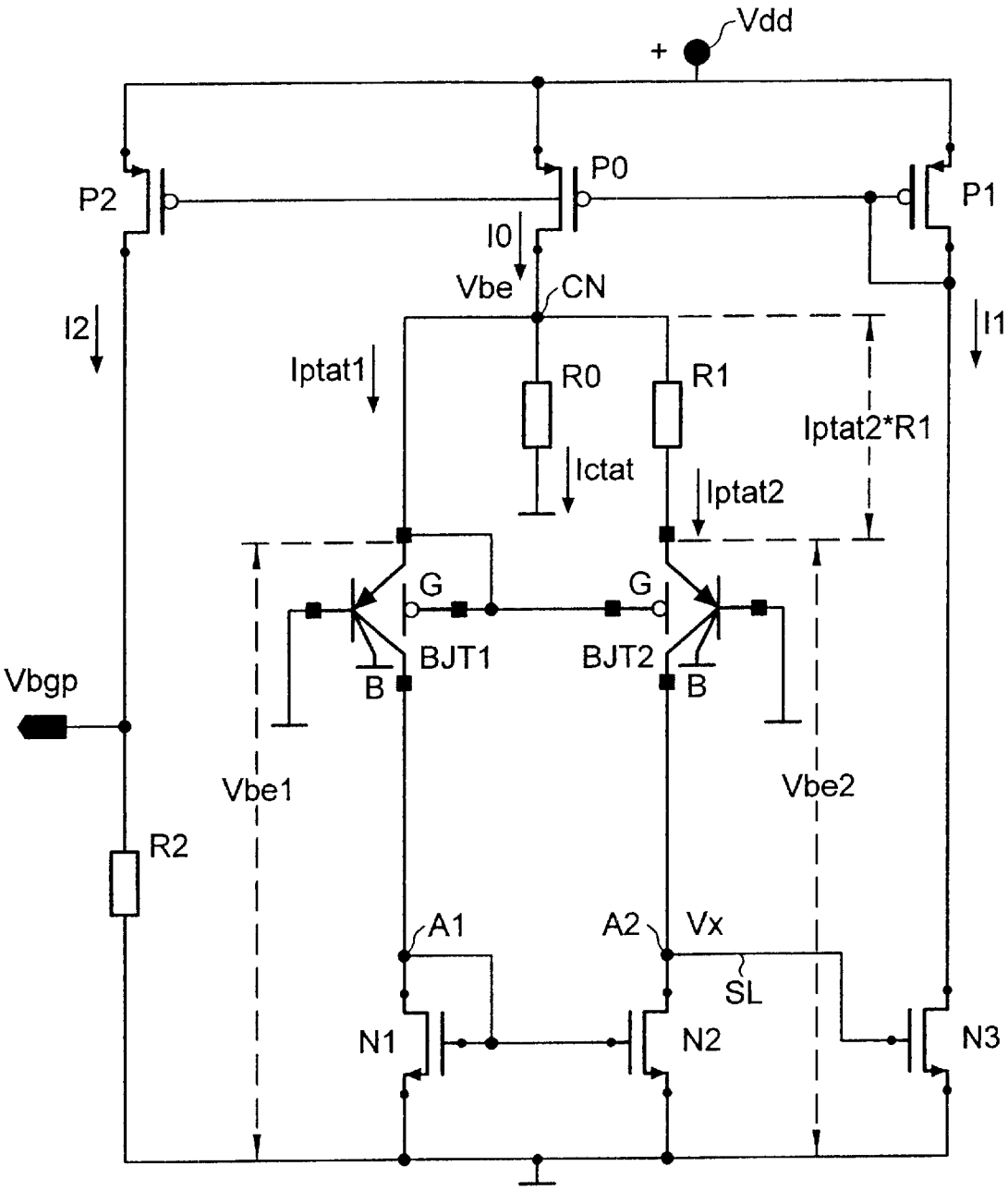
Vdd
+
P0
P2
P1
I0
Vbe
CN
I2
I1
Iptat1
R0
R1
Iptat2*R1
Ictat
Iptat2
G
G
BJT1
BJT2
B
B
Vbgp
Vbe1
Vbe2
R2
A1
A2
Vx
SL
N1
N2
N3

CIRCUIT FOR GENERATING A REFERENCE VOLTAGE BASED ON TWO PARTIAL CURRENTS WITH OPPOSITE TEMPERATURE DEPENDENCE

BACKGROUND OF THE INVENTION

FIELD OF THE INVENTION

The invention relates to a circuit for generating a temperature-stabilized reference voltage on a semiconductor chip.

Circuits of this type are known in semiconductor circuit engineering as bandgap reference (BGR) circuits. BGR circuits are used to a great extent as voltage references for operating voltages in analog, digital and mixed analog-digital circuits.

Conventional BGR circuits operate on the principle of the addition of two partial voltages with opposite temperature responses. While one partial voltage rises proportionately with the absolute temperature (PTAT partial voltage, also referred to as "proportional to absolute temperature"), the other partial voltage falls as the temperature rises. By a suitably adjusted voltage divider, the two partial voltages are scaled in such a way that their temperature dependencies or temperature coefficients add when they are added to form the total voltage. This condition (temperature compensation) defines the level of the two partial voltages and has the effect that, by using this method (addition of two partial voltages), no reference voltages (that is to say operating voltage) below 1.2 V can be formed.

In recent times, CMOS fabrication processes have been discussed, with which circuits can be implemented which need operating voltages in the range of 1.1 V or below.

Reference voltages below 1.2 V can at present be implemented only by the "current-mode" technique. In this technique, two partial currents are added and converted into the reference voltage to be generated.

In the article titled "A CMOS Bandgap Reference Circuit with Sub-1-V Operation", by H. Banba et al., IEEE JSSC, Vol. 34, pp. 670–674 (1999), a description is given of a BGR circuit which makes it possible to generate reference voltages as low as 0.9 V. In order to generate the two partial currents, use is made of a balanced circuit, the result of the special resistance wiring of the current branches of the balanced circuit achieving the situation where only one control loop is needed to generate the two partial currents. The control loop is implemented by a CMOS operational amplifier, whose inputs are connected to voltage taps on the two branches of the balanced circuit and whose output controls the gate terminals of both transistors in the balanced circuit. The disadvantages of this circuit are that, because of the offset of the CMOS operational amplifier, a low accuracy is achieved, and that the additional resistance wiring of the branches of the balanced circuit produces a relatively high required area.

In the article titled "A 1.1 V Current-Mode and Piecewise-Linear Curvature-Corrected Bandgap Reference", by G. A. Rincon-Mora et al., IEEE JSSC, Vol. 33, pp. 1551–1554, (1998), a BGR circuit is described which, in order to achieve a reference voltage of 1.1 V, likewise uses the current-mode technique. Because of a curve correction to the output reference voltage, the circuit has a good accuracy and temperature stability. However, the drawback is the high expenditure on circuitry in the BGR circuit, and also the use of bipolar transistors, which cannot be produced with a cost-effect standard CMOS fabrication process.

In the article titled "CMOS Voltage References Using Lateral Bipolar Transistors", by M. G. R. Degrauwe et al., IEEE JSSC, Vol. 20, pp. 1151–1157 (1985), a BGR circuit is described in which CMOS-compatible lateral bipolar transistors are used in a reference amplifier to generate the reference voltage, see in particular FIG. 10. The drawback with this circuit is that, on account of the base-current compensation used and the fact that no current-mode technique is used, only operating voltages of 1.6 V and above are possible.

SUMMARY OF THE INVENTION

It is accordingly an object of the invention to provide a circuit for generating a reference voltage on a semiconductor chip which overcomes the above-mentioned disadvantages of the prior art devices of this general type, which is simple to construct and is suitable for generating a reference voltage below 1.2 V. In addition, the intention is also to achieve a high accuracy of the temperature compensation.

With the foregoing and other objects in view there is provided, in accordance with the invention, a circuit for generating a temperature-stabilized reference voltage on a semiconductor chip, in which two partial currents with opposite temperature dependence are generated, superimposed on each other and converted into the reference voltage. The circuit contains a first circuit section formed as a differential amplifier having a common node and two lateral bipolar transistors for generating a first partial current. The two lateral bipolar transistors include a first lateral bipolar transistor and a second lateral bipolar transistor having a greater active area than the first lateral bipolar transistor, each of the two lateral bipolar transistors have an emitter terminal, a base terminal and a collector terminal.

A second circuit section for generating a second partial current is connected to the common node, and a component with an electrical resistance is disposed between the common node and the emitter terminal of the second lateral bipolar transistor with the greater area.

The circuit according to the invention operates on the current-mode technique, that is to say two partial currents with opposite temperature dependence are generated, superimposed on each other and converted into the reference voltage. One of the two partial currents, namely the PTAT partial current, is generated in a first circuit section of the circuit, which is formed in the form of a differential amplifier with two lateral bipolar transistors. The special feature of the differential amplifier is that one lateral bipolar transistor has a greater active area than the other lateral bipolar transistor, and that a component with an electrical resistance is disposed between the common node of the differential amplifier and the emitter terminal of the bipolar transistor with the greater area. These two measures (lateral bipolar transistors of different area and asymmetrical emitter wiring of the differential amplifier) have the effect of generating the PTAT partial current in a novel way, the partial current being composed of the two currents flowing through the lateral bipolar transistors.

The base terminals of both bipolar transistors are preferably connected to a common fixed potential, in particular ground. As a result (differing from the circuit described in the article by M. G. R. Degrauwe, in which the base terminals of the two lateral bipolar transistors are used as the input to the differential amplifier) an influence of unknown base currents is ruled out, which permits high accuracy of the temperature compensation and a low operating voltage.

A further preferred measure of the invention is distinguished by the fact that the second circuit section contains a first resistor, which is located between the common node of the differential amplifier and the fixed potential. By use of the first resistor, the second partial current is implicitly superimposed on the first partial current, the magnitude of the second partial current being proportional to the (controlled) potential at the common node of the asymmetric differential amplifier. This leads to a very simple and compact circuit, since a temperature-compensated reference current is generated with only one control loop and a minimum number of resistors (specifically only the first resistor).

In accordance with an added feature of the invention, a balanced circuit is connected to the differential amplifier and has a first branch through which a collector current of the first lateral bipolar transistor flows, and a second branch through which a collector current of the second lateral bipolar transistor flows.

In accordance with an additional feature of the invention, a further resistor is connected to the common fixed potential terminal. A further balanced circuit is provided and has a first branch feeding the common node and a second branch containing the further resistor disposed therein and across the further resistor the reference voltage is tapped off.

In accordance with another feature of the invention, the further balanced circuit performs 1:1 current balancing.

In accordance with a further feature of the invention, the further balanced circuit has a common control input. The further balanced circuit has two transistors each with a control terminal, one of the transistors is disposed in each of the first branch and the second branch. The control terminal of each of the transistors is connected to the common control input of the further balanced circuit. A control transistor having a control terminal is connected to the collector terminal of the second lateral bipolar transistor with the greater area. The control transistor is further connected to the common control input of the further balanced circuit.

In accordance with a concomitant feature of the invention, the base terminal of both of the two lateral polar transistors are connected to the common fixed potential terminal.

Other features which are considered as characteristic for the invention are set forth in the appended claims.

Although the invention is illustrated and described herein as embodied in a circuit for generating a reference voltage on a semiconductor chip, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a circuit diagram of a BGR circuit according to the invention.

DESCRIPTION OF THE PREFERRED EMBODIMENTS

Referring now to the single FIGURE of the drawing, there is shown a circuit according to the invention. The circuit has a circuit junction referred to as a common node CN, which forms an input to an asymmetric differential amplifier. The asymmetric differential amplifier contains a first lateral bipolar transistor BJT1, a second lateral bipolar transistor BJT2 and a first resistor R1. An emitter of the first lateral bipolar transistor BJT1 is connected directly to the common node CN, while an emitter of the second lateral bipolar transistor BJT2 is connected to the common node CN via the first resistor R1. The two base terminals of the two lateral bipolar transistors BJT1, BJT2 are at the same potential, here, for example, ground. Points A1 and A2 represent two (imaginary) outputs from the differential amplifier circuit, which are each connected to collectors of the two lateral bipolar transistors BJT1 and BJT2.

CMOS-compatible lateral bipolar transistors are known in art. They substantially contain a metal oxide semiconductor (MOS) transistor that is operated in a (lateral) bipolar mode. The particular advantage of such lateral bipolar transistors is that these transistors can be implemented within the context of CMOS technology. The fabrication process additionally necessitates an additional vertical bipolar component, the vertical collector of course being represented by the substrate ("bulk").

In addition to the usual bipolar transistor terminals (base, emitter, collector), lateral bipolar transistors have two further terminals, namely a gate and a bulk, for this reason. The bulk terminals B of the two lateral bipolar transistors BJT1, BJT2 are connected to ground, the two gates G are preferably connected to the highest possible potential and, here, are connected to the common node CN.

The second lateral bipolar transistor BJT2 has a greater active area than the first bipolar transistor BJT1. The greater area of the second lateral bipolar transistor BJT2 can be achieved, for example, by the second lateral bipolar transistor BJT2 being implemented from a number of parallel-connected individual transistors. The area ratio between the second and first lateral bipolar transistors BJT2 and BJT1 is designated below by N.

In the present example, N is selected to be 8, that is to say the second lateral bipolar transistor BJT2 is composed of eight individual transistors in a parallel circuit.

The asymmetric (since provided with the first resistor R1) differential amplifier is supplied with current via an NMOS field effect transistor (FET) P0. The FET P0 is part of a first balanced circuit, which has a further NMOS FET P2 and, at its input, the NMOS FET P1. The source terminals of all the FETs of the first balanced circuit are connected to a positive operating voltage Vdd. The gate terminals of all the FETs of the first balanced circuit are connected to one another. The drain terminal of the FET P1 implements the input to the balanced circuit and, as is common in the case of a "simple balanced circuit", is connected to the gate terminals of all the FETs P1, P0, P2 of the first balanced circuit.

A drain terminal of the FET P2 is connected to ground via a second resistor R2. The temperature-compensated reference voltage Vbgp is tapped off with respect to ground across the second resistor R2.

As explained in more detail below, the first balanced circuit has the function of ensuring that a current flows through the second resistor R2 at the same level as through the common node CN. Due to the second resistor R2, the current is then converted into the desired reference voltage.

It becomes clear from the FIGURE that the common node CN is further connected via a resistor R0 to ground, in the general case to the common potential of the base terminals of the two lateral bipolar transistors BJT1, BJT2.

The circuit contains a second balanced circuit, which is implemented by the NMOS FET N1 and N2. A drain terminal of the FET N1 is connected to the first output A1 of the asymmetric differential amplifier, and the drain terminal of the FET N2 is connected to the second output A2 of the differential amplifier. The source terminals of N1 and N2 are connected to ground. The gate terminals of N1 and N2 are connected to each other and are also connected to the first output A1 of the differential amplifier. This circuit construction implements a simple balanced circuit, as it is known.

Connected to the second output A2 of the differential amplifier is a control line SL, which is routed to a gate terminal of a control FET N3. The drain terminal of the control transistor N3 is connected to the input (gate terminal of the FETs P1, P0, P2) of the first balanced circuit and therefore controls the latter as a function of the potential Vx at the second output A2 of the asymmetric differential amplifier.

The functioning of the BGR circuit illustrated in the FIGURE will now be explained below.

In the circuit diagram, the following currents occur:

I0: Control-loop current through P0
I1: Source current of the FET P1
I2: Source current of the FET P2 (output current)
Iptat1: Emitter current of BJT1
Iptat2: Emitter current of BJT2
Ictat: Current through R0

Since the control-loop current I0 is composed of the currents through the two branches of the asymmetric differential amplifier and of the current through the resistor R0, it is true that:

$$Iptat1+Iptat2+Ictat=I0 \quad (1)$$

The control function of the circuit is substantially achieved by the differential amplifier (BJT1, BJT2, R1) and the second balanced circuit (N1, N2). For the purpose of improved understanding, in the following consideration the resistor R0 will initially be ignored. The control-loop current I0 is then divided into the two partial currents Iptat1 and Iptat2. By the second balanced circuit, the collector currents of BJT1 and BJT2 are then compared with each other. As a result of this comparison, the voltage Vx appears at the output A2 of the first amplifier stage. The voltage, as already explained, is amplified in the FET N3 (which to this extent implements a second amplifier stage), and, via the FET P1, is used to control the first balanced circuit. Here, the FET P1 acts both as a load element for the second amplifier stage (FET N3) and as an input to the first balanced circuit. Since the FETs N1 and N2 of the second balanced circuit are identical, the closed control loop sets a control-loop current I0 which has the effect that the collector current of BJT1 is identical to the collector current of BJT2.

Given identical collector currents of the two lateral bipolar transistors BJT1 and BJT2, their emitter currents Iptat1 and Iptat2 are also the same. This is ensured despite the vertical bipolar component of the two lateral bipolar transistors BJT1 and BJT2, to be specific because the percentage "current loss" in the two bipolar transistors is equally high (the current loss is composed of the current losses through the vertical collector and the base terminal of a lateral bipolar transistor and, at a given forward current, is independent of the area of the lateral bipolar transistor).

This therefore results in the control-loop condition:

$$Iptat1=Iptat2= \quad (2)$$

Iptat designating the value of the two identical emitter currents Iptat1 and Iptat2.

The first resistor R1 now brings about an additional voltage drop between the common node CN and the emitter of BJT2. This leads to "asymmetric emitter degeneration" in the differential amplifier and has the effect of negative feedback in the control loop.

Vbel designates the emitter voltage on BJT1, and Vbe2 designates the emitter voltage on BJT2. Vbe designates the voltage at the common node CN. Because of the voltage divider implemented by the second lateral bipolar transistor BJT2 and the resistor R1, the following relationship results:

$$Vbe=Vbe1=Iptat*R1+Vbe2 \quad (3)$$

The voltage dependence of the currents Iptat1 and Iptat2 can be expressed by the known diode equation:

$$Iptatx=Isx\times(\exp(q*Vbex/k*T)-1) \text{ where } x=1, 2 \quad (4)$$

Here, Is1, Is2 designate the reverse currents through the transistors BJT1 and BJT2, q is the electron charge ($1.6*10^{-19}$ C), k is the Boltzmann constant ($1.38*10^{-23}$ J/K) and T is the absolute temperature expressed in Kelvin.

From the diode equation, the following relationship results for Vbex>>k*T/q:

$$Vbex=VT*ln(Iptatx/Isx) \quad (5)$$

Here, VT=k*T/q designates the thermal voltage increasing proportionally with the absolute temperature T.

From the equations (2), (3) and (5) it follows that:

$$VT*ln(Iptat/Is1)=VT*ln(Iptat/Is2)+Iptat*R1 \quad (6)$$

This results in the following relationship:

$$Iptat = (VT/R1)*\ln(Is2/Is1) \quad (7)$$
$$= (VT/R1)*\ln(N)$$

Equation (7) makes it clear that, by use of the control loop, a defined current with the desired positive, linear temperature dependence (on account of VT) is generated, which can be scaled by the value of the first resistor R1 and the area ratio N. This current is the PTAT current.

By the previously ignored resistor R0, an additional current Ictat is added to the PTAT current, its amplitude being determined by the voltage Vbe but the additional current does not influence the partial currents Iptat. Since the FET P0 has to supply this current in addition to the two partial currents 2*Iptat, the voltage Vx at the second output A2 of the asymmetric differential amplifier circuit is "automatically" set to a correspondingly higher value during control operation.

Adequate sensitivity in the control-loop operation is ensured in this case by the control transistor N3, which implements current amplification in the feedback loop. The control transistor N3 generates from the voltage Vx the current I1, from which the current I0=k1*I1 for the common node CN is then derived (k1 designates the current gain or the balancing ratio of the balanced circuit P1, P0).

For the closed control loop it is therefore true that:

$$I0=2*Iptat+Ictat$$

$$Ictat=Vbe/R0 \quad (8)$$

The current Ictat added by the resistor R0 in this case has a negative temperature dependence, since it is proportional to Vbe. For the total current I0, the relationship:

$$I0=(2*VT/R1)*ln(N)+Vbe/R0 \quad (9)$$

is therefore true.

As already mentioned, the output current I2 flowing through the second resistor R2 is derived from the total current I0 via the first balanced circuit (FETs P0 and P2), and generates the reference voltage Vbgp in accordance with the following equation:

$$Vbgp=(2*VT*R2/R1)*ln(N)+Vbe*R2/R0 \quad (10)$$

By a suitable choice of the resistance ratio of R1/R0, the two partial currents Iptat and Ictat can be weighted in such a way that their temperature coefficients cancel. It can be seen from equation (10) that, via the second resistor R2, any desired scaling of the output voltage Vbgp within the operating voltage Vdd is possible. It is assumed here that the three resistors R0, R1, R2 have substantially identical temperature coefficients.

The three resistors R0, R1, R2 can have, for example, the values R0=50.5 kΩ, R1=10.8 kΩ and R2=57.0 kΩ.

In summary, the way in which the circuit according to the invention functions is based on the fact that the two lateral bipolar transistors BJT1 and BJT2 operate in an asymmetric differential amplifier, but are not driven via their base terminals. For this purpose, the resistor R1 is used instead for single-sided emitter degeneration such that in the closed control loop the desired PTAT current 2*Iptat is generated. In this case, the differential amplifier is driven via the common node CN. Furthermore, a partial current Ictat needed for compensation is generated by the resistor R0 at the common node CN of the differential amplifier.

The circuit according to the invention permits the implementation of low temperature-compensated output voltages Vbgp below 1.0 V. A significant advantage is that this is achieved by a simple, rugged and space-saving circuit implementation that manages with only few components. Further significant advantages of the invention consist in that, as a result of the use of (low-offset) lateral bipolar transistors, higher inaccuracies resulting from offset at the amplifier input stage are avoided. Furthermore, the circuit is insensitive with respect to the (predominantly unknown) electrical characteristics of the lateral bipolar transistors, since the latter are not driven via their base.

I claim:

1. A circuit for generating a temperature stabilized reference voltage on a semiconductor chip, in which two partial currents with opposite temperature dependence are generated, superimposed on each other and converted into the reference voltage supplied at an output of the circuit, the circuit comprising:

a common node;

a first circuit formed as an asymmetric differential amplifier for generating a first partial current based on the asymmetric characteristic of said asymmetric differential amplifier, said asymmetric differential amplifier having two lateral bipolar transistors and an electrical resistance element, said two lateral bipolar transistors including a first lateral bipolar transistor and a second lateral bipolar transistor having a greater active area than first lateral bipolar transistor, each of said two lateral bipolar transistors having an emitter terminal, a base terminal and a collector terminal, the emitter terminal of said first lateral bipolar transistor being electrically connected to said common node, and the emitter terminal of said second lateral bipolar transistor being connected to said common node through said electrical resistance element;

a second circuit for generating a second partial current having opposite temperature dependence of said first partial current, said second circuit being connected to said common node; and a balanced circuit connected to said common node for converting said first and second partial currents into the reference voltage, said balanced circuit having a first branch for feeding said common node with a current and a second branch having an output resistor connected to the output for converting current flowing through said second branch into the reference voltage.

2. The circuit according to claim 1, further including a common fixed potential terminal for receiving a common fixed potential, said base terminals of said two lateral bipolar transistors being connected to said common fixed potential terminal.

3. The circuit according to claim 2, wherein said second circuit has a resistor connected between said common node and said common fixed potential terminal.

4. The circuit according to claim 3, further including another balanced circuit connected to said asymmetric differential amplifier, said another balanced circuit having a first branch through which a collector current of said first lateral bipolar transistor flows, and a second branch through which a collector current of said second lateral bipolar transistor flows.

5. The circuit according to claim 2, wherein said output resistor is connected to said common fixed potential terminal.

6. The circuit according to claim 2, wherein said common fixed potential is a ground potential.

7. The circuit according to claim 1, wherein said balanced circuit performs 1:1 current balancing.

8. The circuit according to claim 1, wherein said balanced circuit has a common control input; said balanced circuit has two transistors each with a control terminal, each one of said transistors is disposed in a respective one of said first branch and said second branch, said control terminal of each of said transistors is connected to said common control input of said balanced circuit; and the circuit further includes a control transistor having a control terminal connected to said collector terminal of said second lateral bipolar transistor with the greater active area, said control transistor being further connected to said common control input of said balanced circuit.

* * * * *